US006363681B1

(12) United States Patent
Neuner

(10) Patent No.: US 6,363,681 B1
(45) Date of Patent: Apr. 2, 2002

(54) NON-TOXIC REINFORCEMENT OF STRUCTURES IN HIGH MOISTURE ENVIRONMENTS

(75) Inventor: John D. Neuner, Bay Point, CA (US)

(73) Assignee: Hexcel Corporation, Dublin, CA (US)

( * ) Notice: Subject to any disclaimer, the term of this patent is extended or adjusted under 35 U.S.C. 154(b) by 0 days.

(21) Appl. No.: 09/486,203

(22) PCT Filed: Nov. 23, 1999

(86) PCT No.: PCT/US99/27860

§ 371 Date: Feb. 23, 2000

§ 102(e) Date: Feb. 23, 2000

(87) PCT Pub. No.: WO00/31360

PCT Pub. Date: Jun. 2, 2000

Related U.S. Application Data

(63) Continuation of application No. 09/198,642, filed on Nov. 24, 1998.

(51) Int. Cl.[7] ..... E04C 3/34

(52) U.S. Cl. ..... 52/723.1; 52/746.1; 52/736.1; 428/317.3

(58) Field of Search ..... 52/309.17, 736.3, 52/736.4, 737.4, 737.5, 738.1, 723.1, 741.3, 741.4, 745.06, 745.19, 746.1; 428/317.3, 317.7

(56) References Cited

U.S. PATENT DOCUMENTS

| | | | |
|---|---|---|---|
| 3,427,190 | A | 2/1969 | Murdock |
| 3,891,583 | A | 6/1975 | Drisko et al. |
| 4,195,001 | A | 3/1980 | Lytton et al. |
| 4,260,700 | A | 4/1981 | Cassutt et al. |
| 4,496,611 | A | 1/1985 | Kawakubo et al. |
| 4,519,856 | A | 5/1985 | Lazzara |
| 4,793,888 | A | 12/1988 | Card et al. |
| 5,030,493 | A | 7/1991 | Rich |
| 5,218,810 | A | 6/1993 | Isley, Jr. |

FOREIGN PATENT DOCUMENTS

| | | |
|---|---|---|
| WO | WO 97/01686 | 1/1997 |
| WO | WO 97/44188 | 11/1997 |

*Primary Examiner*—Beth A. Stephan
(74) *Attorney, Agent, or Firm*—Sharpiro, Borenstein & DuPont

(57) ABSTRACT

Reinforcement of structures in high moisture environments is achieved by applying reinforcement layers which include a fabric portion (34) and an uncured resin portion (56) where the uncured resin contains a conversion agent and a thickening agent. The uncured reinforcement layer (44) is cured in place about the structure to form a composite reinforcement shell (32). The uncured reinforcement layer (44) is formed from woven or stitched unidirectional fabric. The invention finds particular use in reinforcing bridge supports and pilings which are at least partially submerged in water. Containment layers are used to prevent resin dilution and de-lamination during curing of the reinforcement structure. The resin used is non-toxic with respect to aquatic wildlife.

20 Claims, 2 Drawing Sheets

NON-TOXIC REINFORCEMENT OF STRUCTURES IN HIGH MOISTURE ENVIRONMENTS

This Application is 371 of PCT/US99/27860 filed Nov. 23, 1999 which is a cont of Ser. No. 09/198,642 filed Nov. 24,1998.

BACKGROUND OF THE INVENTION

1. Field of the Invention

The present invention relates generally to reinforcing large scale support structures which are present in high moisture environments. More particularly, the present invention involves reinforcing structures which are at least partially immersed in either fresh or salt water. Reinforcement is accomplished utilizing composite materials which are wrapped around the structures in situ to form underwater reinforcements. The invention is intended for use in those environments where toxicity to fish and other aquatic wildlife may be of concern.

2. Description of Related Art

Concrete columns are widely used as support structures. Bridge supports, freeway overpass supports, building structural supports and parking structure supports are just a few of the many uses for concrete columns. Concrete columns exist in a wide variety of shapes. Concrete columns with circular, square and rectangular cross-sections are most common. However, numerous other cross-sectional shapes have been used including regular polygonal shapes and irregular cross-sections. The size of concrete columns also varies greatly depending upon the intended use. Concrete columns with diameters on the order of 2 to 20 feet and lengths of well over 50 feet are commonly used as bridge or overpass supports.

It is common practice to reinforce concrete columns with metal rods or bars. The metal reinforcement provides a great deal of added structural strength to the concrete column. Although metal reinforcement of concrete columns provides adequate structural reinforcement under most circumstances, there have been numerous incidents of structural failure of metal-reinforced concrete columns when subjected to asymmetric loads generated during earthquakes. The structural failure of a metal reinforced concrete support column during an earthquake can have disastrous consequences. Accordingly, there is a continuing need to enhance the ability of concrete columns to withstand the asymmetric loads which are applied to the column during an earthquake.

One way of increasing the structural integrity of concrete columns is to include additional metal reinforcement prior to pouring the concrete column. Other design features may be incorporated into the concrete column fabrication in order to increase its resistance to asymmetric loading. However, there are hundreds of thousands of existing concrete supports located in earthquake prone areas which do not have adequate metal reinforcement or structural design to withstand high degrees of asymmetric loading. Accordingly, there has been a concentrated effort to develop systems for reinforcing such existing concrete columns to prevent or reduce the likelihood of failure during an earthquake.

One example of a method for increasing the structural strength of existing concrete structures is set forth in U.S. Pat. No. 4,786,341. In this particular patent, the outer surface of the concrete column is reinforced by wrapping a fiber around the column in a variety of different patterns. A problem with this particular method is the amount of time required to wrap a concrete column with a single fiber is time consuming and expensive.

One approach to reinforcing the exterior of an existing concrete support column is set forth in U.S. Pat. No. 5,043,033. In this patent, the exterior of the concrete column is wrapped with a composite material to form a shell surrounding the concrete column. The space between the outer composite shell and the concrete column is then pressurized by injecting a hardenable liquid.

Another approach, as set forth in U.S. Pat. No. 5,218,810 involves wrapping large columns with composite reinforcement layers to form a reinforcing shell which is in direct contact with the column surface.

Although the above reinforcement procedures are well-suited for reinforcing structures in relatively dry environments, they are not suitable for use where water is present. For example, numerous bridge supports columns include substantial portions which are located under water. Such underwater columns are present in both fresh water and salt water environments. Accordingly, there is a present need to provide composite type reinforcement methods and systems which can be used under water. One such method is described in PCT International Publication No. WO 97/44188.

In addition to concrete columns, there are numerous other types of structures present in high moisture environments which require periodic reinforcing. Pier or pilings in both fresh water and salt water are made from many different types of materials, including metal, wood and concrete. These types of structures are subject to continual deterioration from the elements. A method and system which can be used simply and efficiently to rehabilitate these types of structures would be extremely advantageous. It also would be desirable to provide such reinforcing structures without creating a toxic hazard to fish and other wildlife.

SUMMARY OF THE PRESENT INVENTION

In accordance with the present invention, a method is provided for reinforcing a wide variety of structures which are located underwater or in other high moisture environments. The invention is based on the discovery that composite materials may be used successfully to reinforce structures in high moisture environments provided that certain epoxy resin compositions are utilized in the resin matrix of the composite.

The invention involves applying to the surface of the structure at least one uncured reinforcement layer to form an uncured shell surrounding the surface. The uncured reinforcement layer includes a fabric portion and an uncured resin portion. As a feature of the present invention, the uncured resin portions contains 80–120 parts by weight epoxy resin and 30–70 parts by weight of a conversion agent. Optionally, 1–10 parts by weight of a thickening agent may be included in the uncured resin. This type of resin, when cured, was found to be especially well-suited for use in providing high strength reinforcement structures in high moisture environments. The uncured resin may also contain up to 10 parts by weight or more of a coloring agent. The coloring agent is useful when it is desirable to hide underlying surface irregularities, such as cracks, or to otherwise provide a desired surface color.

As another feature of the present invention, a containment layer is placed around the uncured reinforcement layer to enhance the curing process in underwater situations or other high moisture environments. The use of stretch wrap as a containment layer is especially useful for support columns and other structures located in river or ocean environments where turbulent water flow or wave action presents unique problems with respect to applying and curing the composite reinforcement.

As an additional feature of the present invention, it was discovered that the above-specified resins were not toxic to aquatic life during the application and curing in underwater conditions.

The above discussed and many other features and attendant advantages of the present invention will become better understood by reference to the following detailed description when taken in conjunction with the accompanying drawings.

DETAILED DESCRIPTION OF THE INVENTION

The present invention has wide application to the reinforcement of large structures which are located either under water or in a high moisture environment. A high moisture environment is one where the structure is consistently exposed to water or air which is saturated with water. Exemplary structures which may be reinforced include bridge support columns, pilings and pier or platform support structures which are at least partially submerged in either fresh or salt water. These types of structures are typically made from reinforced concrete, wood, metal and combinations thereof.

Figure 1:
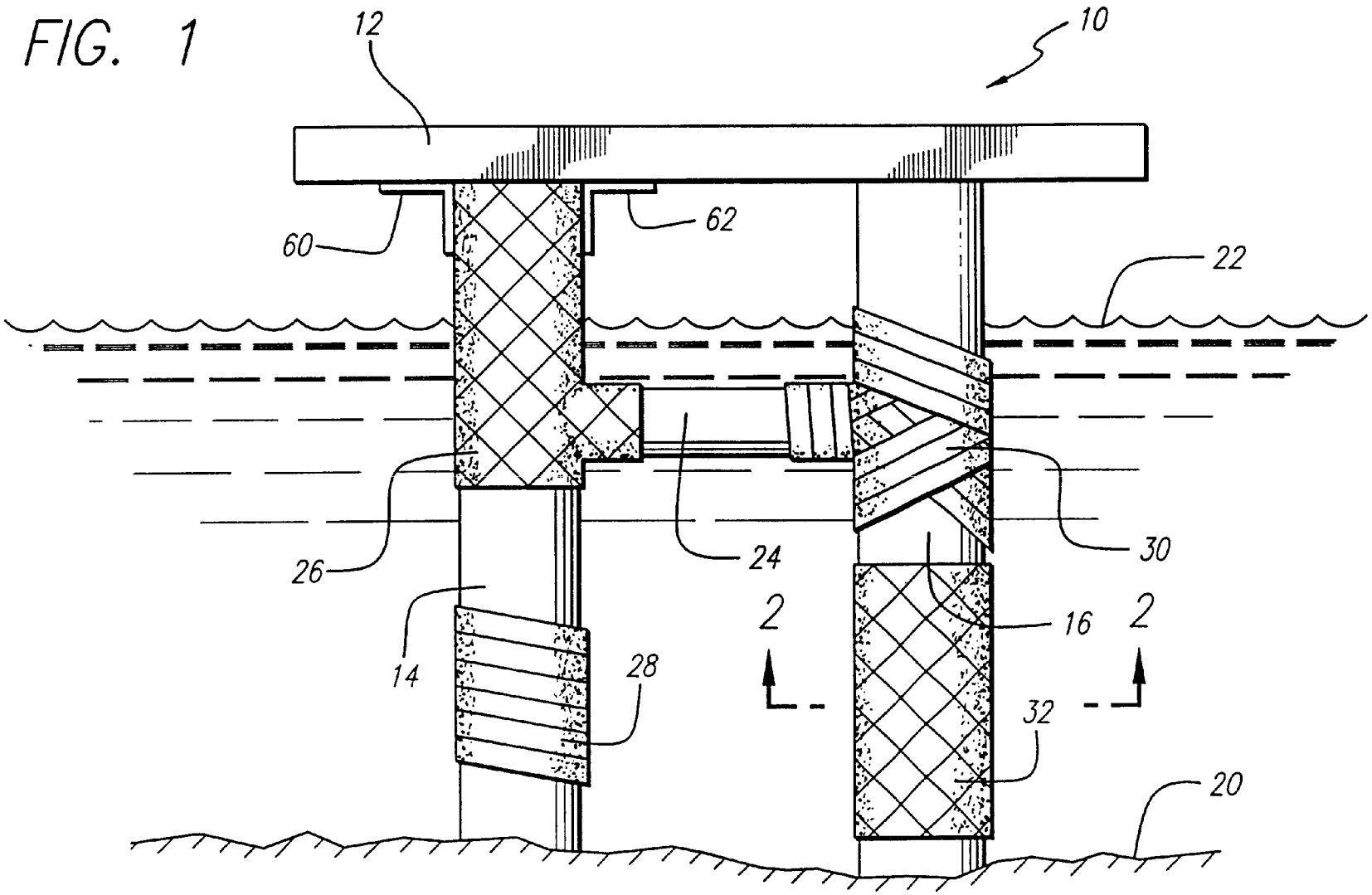
FIG. 1 is a side view of a platform which includes partially submerged support structures which include four exemplary reinforcements in accordance with the present invention.

An exemplary platform which is reinforced in a number of different places is shown generally at 10 in FIG. 1.

The platform 10 includes a deck 12 and supporting columns 14 and 16. Both columns 14 and 16 are anchored to an ocean or lake floor 20 and extend above the lake or ocean surface 22. A cross support beam 24 extends between the support columns 14 and 16. For exemplary purposes, the platform 10 is shown having four different exemplary types of reinforcements at locations 26, 28, 30 and 32.

It will be understood by those skilled in the art that the platform 10 is shown for exemplary purposes only, and that the reinforcement methods and materials described herein with respect to this example may also be used to reinforce large-scale structures in other high-moisture environments.

Figure 2:
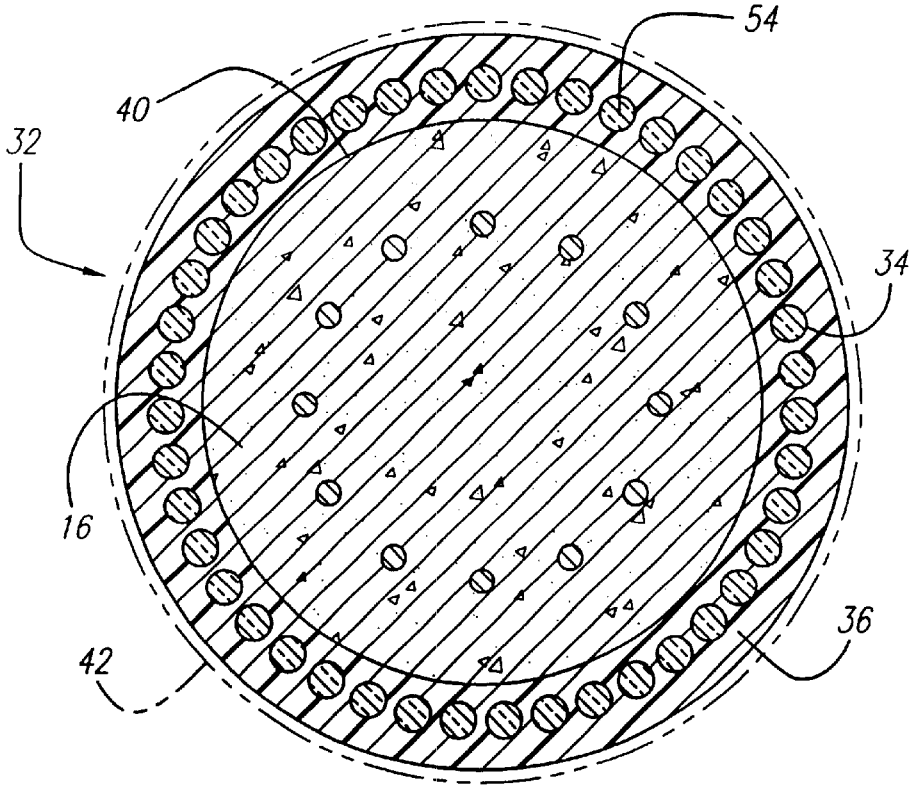
FIG. 2 is a sectional view of one of the reinforcements of FIG. 1 taken in the 2—2 plane.

A cross section of reinforcement structure or shell 32 is shown in FIG. 2. The reinforcement shell includes a reinforcement layer comprising a fabric portion 34 and a resin portion depicted as resin matrix 36. The shell 32 surrounds the surface 40 of column 16. Column 16 in this example is concrete reinforced with steel. However, the column could equally as well be made from wood or metal. The surface 40 of column 16 defines a continuous surface around which the shell 32 has been formed. The reinforcement shell 32 further includes an exterior layer of stretch wrap which is shown in phantom at 42.

Figure 3:
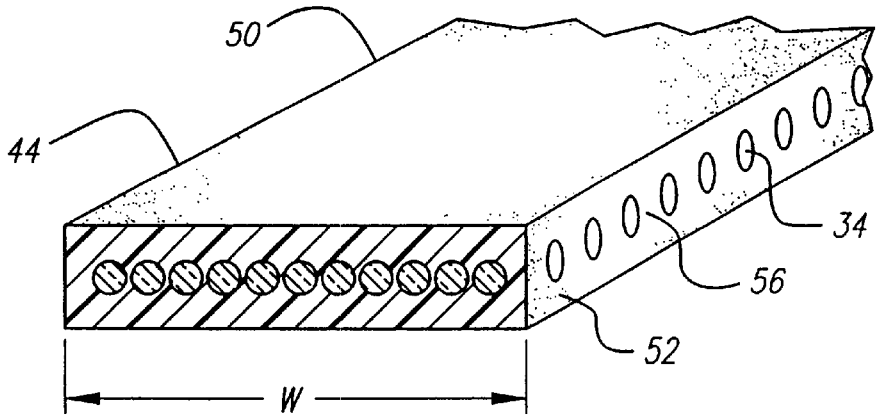
FIG. 3 is a partial schematic view of an exemplary uncured reinforcement layer prior to application to the surface of a support structure.

Referring to FIG. 3, a partial sectional schematic view of the shell is shown when it is in the form of an uncured reinforcement layer prior to application to the column surface 40. This uncured reinforcement layer 44 includes the fabric portion 34 and the uncured resin portion 56. Upon curing, the resin portion 56 becomes the cured resin matrix 36 shown in FIG. 2. The uncured reinforcement layer 44 has two selveges 50 and 52 as shown in FIG. 3. The width of the fabric "W" may be from 3 to 100 inches or more. For shell 32, the width of the fabric is on the order of 4 to 6 feet. Larger sizes become unmanageable at the job site, especially when divers or other personnel must transport the uncured reinforcement layer under water to the structure being reinforced.

The fabric portion 34 preferably includes a woven fabric which is impregnated with resin prior to application to the structures. The woven fabric may be made from any of the known fiber material commonly used in high strength composite structures. Exemplary fibers include glass, polyaramid, graphite, silica, quartz, carbon, ceramic and polyethylene. Preferably, the preferred fabric is a plain weave, predominantly warp unidirectional fabric comprised of a warp (0 degree orientation of E-glass or carbon roving) and a weft (90 degree orientation) of E-glass and a thermoplastic adhesive. The ratio of warp to weft fiber is about 17.5 to 1 by weight for glass and about 14 to 1 for graphite. In another orientation the fabric will extend at a plus bias angle of between about +20 to +70° relative to the selve edges and a minus bias angle of between about −20 to −70° relative to the selve edges. The diameter of the fibers used in the woven fiber mat preferably range from about 3 microns to about 30 microns depending on the particular fiber. It is preferred that the fibers be bundled into yarns which include between about 200 to 8,000 fibers. The fabric may also be a plain woven fabric, but may also be a 2 to 8 harness satin weave. The number of warp yarns per inch is preferably between 40 to 60. The preferred number of fill yarns per inch is preferably between about 40 to 60. The particular weave pattern and orientation of fibers may be varied depending upon the particular structure being reinforced. A woven mat may be stitched or adhesively bonded to the fabric.

The invention is particularly well-suited for reinforcing large columns or pilings which have diameters on the order of 1 to 15 feet and which have lengths on the order of 10 to 50 feet or higher. The invention may also be used to reinforce beam connections in the same manner as set forth in PCT Application WO 97/01686.

The resin used to impregnate the fabric is an epoxy resin formulation which includes the epoxy resin, a conversion agent, an optional thickening agent and an optional coloring agent. The ingredients are preferably present in the amounts set forth in Table 1.

TABLE 1

| Resin Ingredient | Parts By Weight |
|---|---|
| Epoxy Resin | 80–120 |
| Conversion Agent | 30–70 |
| Thickening Agent | 0–10 |
| Coloring Agent | 0–10 |

Resin is preferably a two-part epoxy resin which is mixed at the site and impregnated into a roll of woven or stitched fabric. Impregnated fabric is then taken physically underwater by divers and wrapped around the deteriorated structure. Part A of the epoxy resin preferably includes a hydrogenated bis A epoxy resin, the coloring agent or agents, if any, and the thickening agent. Part B contains the conversion agent. It is preferred that the bis A epoxy be hydrogenated since hydrogenated epoxies are more resistant to ultraviolet light. Although any number of different hydrogenated bis A epoxy resins may be used, it is preferred that EPALLOY 5,000, which is made by CVC Specialty Chemicals (Maple Shade, N.J.) be utilized. An alternate preferred epoxy is available from Shell Oil Company (Houston, Tex.) under the tradename EPONEX 1510. Other suitable resins include EPON 828 available from Shell Oil Company (Houston, Tex.); ARALDITE 6010 available from CIBA-GEIGY (Brewster, N.Y.); and DER 331 available from Dow Chemical (Midland, Mich.). Various mixtures and blend of the resins may be used.

Silica particles are a preferred thickening agent with glass beads (Q-cells) or other known thickening agents being suitable. A preferred thickening agent is hydrophobic fumed silica which is available from Cabot (Tuscola, Ill.) under the tradename CAB-O-SIL TS720. It is preferred that sufficient fumed silica or other thickening agent be added in an amount that provides an uncured resin having a viscosity on the order of 3,000 to 50,000 cps. The resin preferably is sufficiently viscous so that it will not be leaked or otherwise flow from the fabric when it is taken underwater for application to the deteriorated structured. On the other hand, the viscosity must be sufficiently low so that the resin can be easily impregnated into the fabric using conventional impregnation techniques.

Any of the known coloring agents may be utilized to provide desired colors to the epoxy resin. Preferred coloring agents include titanium oxide and carbon black. The amount of titanium dioxide and/or carbon black can be varied to achieve different coloring densities which may vary, through varying shades of gray, from white to black. Titanium dioxide available from DuPont (Wilmington, Del.) is available under the tradename TiPute R960. Carbon black may also be introduced into the resin in the form of JEFFCO BLACK which is a product available from Jeffco Products (San Diego, Calif.). JEFFCO BLACK is a 50/50 mixture by weight of bis A epoxy resin and carbon black.

The conversion agent is a polyaminoamid adduct that is only partially water soluble. The conversion agent is a proprietary product available from WITCO (Bergkamen Germany) under the tradename EUREDUR 450. Other suitable conversion agents include ANCHAMINE 2143 which is modified cycloaliphatic amine which is made by Air Products (Allentown, Pa.), and ANCHAMINE 2280 which is a modified amine which is also made by Air Products (Allentown, Pa.). Conversion agents which were found to not be suitable for use in accordance with the present invention include VERSAMID 140 available from Henkel (LaGrange, Ill.) and GENAMID 151 which is also available from Henkel. Both VERSAMID 140 and GENAMID 151 become milky in water and therefore are potentially toxic to fish. Versamid 140 is too high in viscosity to dip for a viable resin candidate.

Other conversion agents which were tested and found not to be suitable include ANCHAMIDE 350A which is an imidazoline/amide made by Air Products (Allentown, Pa.). The modulus of the resulting material is too low. An alkylated phenolic polyamine conversion agent available from Ciba Polymers (Brewster, N.Y.) under the tradename HY3440 was also found to have a relatively short cure time which is not well suited for use in the present invention where cure times need to be fairly long in order to allow impregnation of the resin into the fabric at the site followed by transport by divers to the submerged structure. The viscosity (1,000–3,000 cps) also had too large a range for practicality.

Other conversion agents which have one or more unsuitable properties include Gaskamine 328 which is a primary amine end capped poly meta xylylamine available from Mitsubishi Gas Chemical Company (Kanagawa, Japan). Gaskamine 328 gives a product which cures to a sticky state in water and is therefore unsuitable. Anchamine 2353 (a modified polyamide from Air Products) had too low a modulus when cured. Suitable conversion agents should produce a resin having relatively long cure times (at least about 4 hours) which can be exposed to water when the resin is submerged as well as producing suitably strong resin matrix. EUREDUR 450, ANCHAMINE 2143 and ANCHAMINE 2280 were found to have such desirable properties. Conversion agents which have properties which are similar to EUREDUR 450, ANCHAMINE 2143 and ANCHAMINE 2280 may also be used.

Exemplary resin matrices in accordance with the present invention will include from 90–100 parts by weight EPALLOY 5,000 which is combined to form part A of the epoxy resin with 5 parts by weight CAB-O-SIL TS720 and from 5 to 7 parts by weight titanium dioxide and 1 to 2 parts by weight JEFFCO BLACK. Part B is EUREDUR 450 which is added to Part A in an amount of from 45 to 55 parts by weight. A particularly preferred 2-part resin will include 100 parts by weight EPALLOY 5,000, 6 parts by weight titanium dioxide, 5 parts by weight CAB-O-SIL TS720, and 1.25 parts per weight JEFFCO BLACK. Part B is EUREDUR 450 which is added to part A in an amount of 48.9 parts by weight.

Another preferred exemplary 2-part epoxy which may be used as a suitable resin matrix contains 100 parts by weight Erysis GE 60 (epoxidized sorbitol resin made by CVC chemical Specialties), 6 parts by weight titanium dioxide, 2 parts by weight CAB-O-SIL TS720 with part B being EUREDUR 450 which is added in an amount of about 80 parts by weight. Here the working time is short (about 30 minutes) and metered mixing at the saturator rolls would be required for field suitability.

Once the uncured reinforcement layer has been wrapped around the column 16, stretch wrap or other similar thin wrapping layer is wrapped over the uncured shell to hold it in place. The stretch wrapping is shown in FIG. 2 as phantom layer 42. The stretch wrap is shown in phantom since it may be removed after final curing or, alternatively, it may be left in place. Any of the commonly used stretch wrap materials may be used to provide the containment layer 42. Stretch wrap is a polymer film which is widely used and readily available from Mobil Oil Corporation under the tradenames MOBILWRAP or MOBIL MASTERWRAP. The wrap is also sold by Borden Chemical Co. under the tradename BORDEN HANDWRAP, and is also available from Uline (Los Angeles, Calif.) under the tradename ULINE ECONO-WRAPPER. Gauges 80–120.

Use of the stretch wrap is particularly preferred in situations where the column 16 is subjected to turbulence. For example, the use of a stretch wrap containment layer 42 is particularly preferred where reinforcing columns are located in areas where wave action or other strong ocean currents are present. Additionally, the use of stretch wrap is preferred in rivers where fast flowing and/or turbulent water may be present. Referring again to FIG. 1, three additional exemplary reinforcements utilizing the composite shells in accordance with the present invention are shown at 26, 28 and 30. Reinforcement 28 is exemplary of the type of reinforcements where the uncured reinforcement layer is wound spirally around column 14. In this type of spiral reinforcement system, the width of the uncured reinforcement layer will range from a few inches to 2 to 3 feet. This type of spiral wrap reinforcement configuration is well-suited for situations where the use of wider fiber matting is not possible. Such situations may occur where only one diver is available or underwater conditions make it difficult to apply relatively wide reinforcement layers to the column or other support structure. When spiral wrapping, as depicted at 28, is used, it is particularly preferred that a final outer layer of stretch wrap be applied to contain the spirally-wrapped reinforcement.

The reinforcement 26 shown in FIG. 1 is similar to the reinforcement shell 32 except that provision is made for extending the reinforcing shell onto horizontal structural beam 24. In addition, the reinforcement shell 26 extends above the water surface 22 and is further adhered to the bottom of deck 12 as shown at 60 and 62.

A fourth exemplary composite reinforcement is shown at 30. This is also an example of using uncured reinforcement layers in accordance with the present invention to form a spirally-wrapped reinforcement. The reinforcement 30 is based upon the same spiral wrapping principle as reinforcement 28, except that it has been adapted to provide reinforcement of the attachment between vertical column 16 and horizontal beam 24. The spiral wrapping shown in reinforcement 30 is partially schematic and exemplary only. Those of ordinary skill in the art will recognize that any number of spiral wrapping orientations are possible in order to achieve reinforcement of the joint between beam 24 and column 16. For example, a typical wrapping of a column will not involve spiral wrapping. Instead, the fabric will be wrapped around the column in a direction perpendicular to the column axis. The next fabric layer is butt spliced against the first wrapping layer. Additional vertically butt-jointed layers are added, as necessary, to cover the entire column (e.g. see U.S. Pat. No. 5,218,810). In addition, the on-site resin may be applied to the structure prior to reinforcement to act as a primer. Also, the on-site resin may be applied as a cosmetic coating over the exterior of the reinforcement once it has been applied to the structure. It is preferred that the resin have a working time of from 3–5 hours in order to allow sufficient time for impregnation and application. However, working times as short as 45 minutes are suitable.

Examples of practice are as follows:

EXAMPLE 1

An underwater fabric is wrapped using glass fabric impregnated with a resin which is prepared at the job site. Glass fabric is provided at the job site as a roll of material which has a width of 24 to 54 inches. Part A of the resin is made using EPALLOY 5,000, titanium dioxide, CAB-O-SIL TS720 and JEFFCO BLACK. The JEFFCO BLACK and titanium oxide are added first to the EPALLOY 5,000 and mixed until uniform. The CAB-O-SIL is added last and stirred at least five minutes with a shear blade until the CAB-O-SIL is dispersed throughout the resin. Part A may be mixed prior to arrival at the job site. At the job site, part B which is EUREDUR 450 is stirred into the part A with the resulting mixture put into the trough of a conventional saturator for use in saturating fabric as it is unwound from the roll. The amounts of various ingredients are added to the mixtures to provide a resin which has 100 parts by weight EPALLOY 5,000, 6 parts by weight titanium dioxide, 5 parts by weight CAB-O-SIL TS720, 1.25 parts by weight JEFFCO BLACK, and 48.9 parts by weight EUREDUR 450.

As soon as the fabric is dipped through the saturator trough, a diver then takes the fabric underwater where it is wrapped around the structure. Immediately thereafter, the diver then wraps over the impregnated cloth with polyethylene stretch wrap such as Uline stretch wrap sold by Uline Corporation (Waukegan, Ill.). In place of fiberglass fabric, stitched unidirectional graphite fabric of aerial weight 650 grams per square meter may be used.

The above systems have viscosities which remain relatively constant for about 4 hours which was found to be adequate time to allow mixing, impregnation and underwater wrapping. In addition, toxicity tests were conducted. The tests showed that the resin system used in the present invention was not toxic to fish. The pH of the resin system is about 7.0 so that toxicity based on pH is also not a problem.

EXAMPLE 2

The same basic procedure as outlined above was followed except that the resin used to impregnate either glass or graphite fabric has the formula Part A: Erysis GE 60, 100 parts by weight; titanium dioxide 6 parts by weight; and CAB-O-SIL TS720, 2 parts by weight Part B: EUREDUR 450, 67.6 parts by weight.

EXAMPLE 3A

The same basic procedure as in Example 1 above was followed, except that the resin used to impregnate either glass or graphite fabric had the formula:

Part A: Epon 828, 100 parts by weight; and titanium dioxide, 4 parts by weight;

Part B: EUREDUR 450, 61 parts by weight Epon 828 is a bis A epoxy from Shell Chemical (Houston, Tex.)

This resin has a working time of about 51 minutes so metered mixing probably would be required at the saturator. Epon 828 gives a higher modulus product after cure than Epalloy 5,000. Various blends of Epalloy 5,000 with Epon 828 can be used in the part A to adjust the working time and hence the underwater cure time.

EXAMPLE 3B

The same basic procedure as in Example 1 above was followed, except that the resin used to impregnate either glass or graphite fabric had the formula:

Part A: Epon 828, 100 parts by weight; titanium dioxide, 4 parts by weight

Part B: ANCHAMINE 2143, 61.5 parts by weight

The resin has a working time of about 58 minutes so metered mixing probably would be required at the saturator.

EXAMPLE 3C

The same basic procedure as in Example 1 above was followed, except that the resin used to impregnate either the glass or graphite fabric had the formula:

Part A: Epon 828, 100 parts by weight; titanium dioxide, 4 parts by weight

Part B: ANCHAMINE 2280; 58.8 parts by weight

This resin has a working time of about 55 minutes so metered mixing probably would be required at the saturator.

Two ply 60% by weight resin content panels were made from the resins in Examples 3A, 3B and 3C on HEX 3R 103 graphite fabric. 103 fabric is 18 oz/yd$^2$ or ounce per square yard aerial weight, mostly unidirectional with about 1.5% by weight thermoplastic thread that is heat set to hold the graphite fibers together. The resin ingredients were mixed together by stirring about 5 minutes then approximately half was poured on to the precut fabric, and then the resin was squeegied on with a stiff rubber plate. A second ply was added similarly with more resin squeegied on the top. This would simulate running the fabric through the saturator.

Two types of panels were made—those cured in air and those cured underwater (both fresh and saltwater). The air cured panels were made on a flat surface lined with smooth polyethylene with the top surfaces open to the air. The underwater cured panels were made by first impregnating the 103 fabric with resin as described above, but then lifting the wet prepreg and inserting it in either fresh or saltwater for enough time to thoroughly wet the prepreg, then putting this wet prepreg on a flat acrylic board. A second ply was made the same way and placed over the first. This water wet uncured two ply prepreg on the acrylic board was then wrapped with about three layers of stretch wrap and placed in either fresh or salt water. After 8 days the panel was removed, quickly cut into sections, the 8 day cure pieces were tested and the remaining were returned to the water for longer soakings (the stretch wrap removed). Room temperature tensile testing was then done on the panels with the following results as shown in Tables 2 and 3.

TABLE 2

| FRESHWATER Example | Cure Type | Tensile Strength (ksi) | Tensile Mod (msi) |
|---|---|---|---|
| 3 | dry cure* | 115 | 10.3 |
| | 8 days underwater | 79 | 9.7 |
| | 60 days underwater | 96 | 9.6 |
| 3A | dry cure* | 106 | 10.4 |
| | 8 days underwater | 116 | 10.2 |
| | 60 days underwater | 113 | 10.1 |
| 3B | dry cure* | 104 | 9.4 |
| | 8 days underwater | 115 | 9.8 |
| | 60 days underwater | 109 | 10.1 |

All values are normalized to 80 mils for comparison
*at least 5 days at room temperature followed by a 48 hour 140° F. post cure

TABLE 3

| SALTWATER Example | Cure Type | Tensile Strength (ksi) | Tensile Mod (msi) |
|---|---|---|---|
| 3 | dry cure* | 115 | 10.3 |
| | 8 days underwater | 84 | 8.9 |
| | 60 days underwater | 94 | 9.1 |
| 3A | dry cure* | 106 | 10.4 |
| | 8 days underwater | 88 | 8.9 |
| | 60 days underwater | 95 | 9.1 |
| 3B | dry cure* | 104 | 9.4 |
| | 8 days underwater | 105 | 9.9 |
| | 60 days underwater | 103 | 9.6 |

All values are normalized to 80 mils for comparison
*at least 5 days at room temperature followed by a 48 hour 140° F. post cure

COMPARATIVE EXAMPLE 4

The same basic procedure as in Example 1 above was followed, except that the resin used to impregnate either glass or graphite fabric had the formula:

Part A: ERL4221, 100 parts by weight; titanium dioxide, 6 parts by weight; and CAB-O-SIL TS720, 6 parts by weight Part B: Euredur 450, 83.9 parts by weight ERL4221 is a cycloaliphatic epoxy resin made by Union Carbide (Danbury, Conn.). This resin system does not cure at room temperature.

COMPARATIVE EXAMPLE 5

The same basic procedure as in Example 1 above was followed, except that the resin used to impregnate either glass or graphite fabric had the formula:

Part A: Erysis GE30, 100 parts by weight, titanium dioxide, 6 parts by weight, CAB-O-SIL TS720, 6 parts by weight Part B: Euredur 450, 80.7 parts by weight GE30 is trimethanolpropane triglydyl ether made by CVC Chemical Specialties. This system was sticky after cure and therefore unsuitable.

Having thus described exemplary embodiments of the present invention, it should be noted by those skilled in the art that the disclosures herein are exemplary only and that various other alternations, adaptations and modifications may be made within the scope of the present invention. Accordingly, the present invention is not limited to the specific embodiments as illustrated herein.

What is claimed is:

1. A method for reinforcing structures in high moisture environments wherein said structure comprises at least one surface that is located underwater, said method comprising the steps of:

applying to said surface at least one uncured reinforcement layer to form an uncured shell on said surface, said reinforcement layer comprising a fabric portion and an uncured resin portion, said uncured resin portion comprising:

80–120 parts by weight epoxy resin and 30–70 parts by weight of a conversion agent; and curing said uncured resin to form a composite shell for reinforcing said structure.

2. A method for reinforcing structures in high moisture environments according to claim 1 wherein said uncured resin portion comprises 1 to 10 parts by weight of a thickening agent.

3. A method for reinforcing structures in high moisture environments according to claim 1 which includes the additional step of placing a containment layer over said uncured shell prior to curing thereof.

4. A method for reinforcing structures in high moisture environments according to claim 1 wherein said uncured resin portion further comprising from 0.1 to 10 parts per weight of a coloring agent.

5. A method for reinforcing structures in high moisture environments according to claim 1 wherein said fabric portion comprises a woven fiber mat wherein said fiber is selected from the group consisting of glass, polyaramid, graphite, silica, quartz, carbon, ceramic and polyethylene.

6. A method for reinforcing structures in high moisture environments according to claim 1 wherein said epoxy resin is a hydrogenated epoxy resin.

7. A method for reinforcing structures in high moisture environments according to claim 4 wherein said coloring agent is selected from the group consisting of carbon black and titanium dioxide.

8. A method for reinforcing structures in high moisture environments according to claim 1 wherein said conversion agent is a polyamino acid adduct, cycloaliphatic amine or modified amine.

9. A method for reinforcing structures in high moisture environments according to claim 3 wherein said containment layer comprises stretch wrap.

10. A structure which is being reinforced in a high moisture environment, said structure being reinforced comprising:

a structure comprising at least one surface that is located underwater;

a reinforcement shell attached to at least a portion of said surface, said shell comprising a reinforcement layer comprising a fabric portion and a resin portion, said resin portion comprising 80–120 parts by weight epoxy resin and 30–70 parts by weight of a conversion agent.

11. A reinforced structure according to claim 10 wherein said resin portion comprises 1 to 10 parts by weight of a thickening agent.

12. A reinforced structure according to claim 10 which further comprises a containment layer located over said reinforcement shell.

13. A reinforced structure according to claim 10 wherein said fabric portion comprises fibers selected from the group consisting of glass, polyaramid, graphite, silica, quartz, carbon, ceramic and polyethylene.

14. A reinforced structure according to claim 10 wherein said resin portion comprises an epoxy resin which is hydrogenated.

15. A reinforced structure according to claim 10 wherein said portion comprises a coloring agent.

16. A reinforced structure according to claim 10 wherein said conversion agent is a polyamino amid adduct, cycloaliphatic amine or modified amine.

17. A structure according to claim 10 wherein said resin portion has been cured to form a reinforced structure.

18. A structure according to claim 11 wherein said resin portion has been cured to form a reinforced structure.

19. A structure according to claim 14 wherein said resin portion has been cured to form a reinforced structure.

20. A structure according to claim 15 wherein said resin portion has been cured to form a reinforced structure.

* * * * *